US007137834B2

(12) United States Patent
Son

(10) Patent No.: US 7,137,834 B2
(45) Date of Patent: Nov. 21, 2006

(54) CONNECTOR OPENING COVER UNIT FOR ELECTRONIC DEVICE

(75) Inventor: Hyeong-sam Son, Suwon-si (KR)

(73) Assignee: Samsung Electronics, Co., Ltd., Suwon-si (KR)

( * ) Notice: Subject to any disclaimer, the term of this patent is extended or adjusted under 35 U.S.C. 154(b) by 0 days.

(21) Appl. No.: 11/046,730

(22) Filed: Feb. 1, 2005

(65) Prior Publication Data

US 2005/0191885 A1 Sep. 1, 2005

(30) Foreign Application Priority Data

Feb. 28, 2004 (KR) ..... 10-2004-0013800

(51) Int. Cl.
*H01R 13/44* (2006.01)

(52) U.S. Cl. ..... 439/136

(58) Field of Classification Search ..... 439/136, 439/135, 142; 312/291; 429/97
See application file for complete search history.

(56) References Cited

U.S. PATENT DOCUMENTS 5,199,888 A * 4/1993 Condra et al. ..... 439/142
6,038,125 A * 3/2000 Anzai ..... 361/609
6,146,198 A * 11/2000 Maeda ..... 439/587
6,352,322 B1 3/2002 Nakao
6,679,710 B1 * 1/2004 Saito et al. ..... 439/142

FOREIGN PATENT DOCUMENTS

| | | |
|---|---|---|
| CH | 677 296 | 4/1991 |
| JP | 2000 151775 | 5/2000 |
| JP | 2000 324212 | 11/2000 |
| KR | 1992-0008250 | 11/1992 |
| KR | 2000-0017862 | 10/2000 |

* cited by examiner

*Primary Examiner*—Phuong Dinh
(74) *Attorney, Agent, or Firm*—Roylance,Abrams,Berdo & Goodman, L.L.P.

(57) ABSTRACT

A connector opening cover unit selectively covers a connector opening to prevent exposing a connector unit inside an electronic device housing. A connector opening is adjacent a device accommodating opening that is selectively openable by a user. A first cover opens and closes the device accommodating opening. A second cover opens and closes the connector opening. The first and second covers are complimentarily locked with each other.

12 Claims, 6 Drawing Sheets

CONNECTOR OPENING COVER UNIT FOR ELECTRONIC DEVICE

CROSS REFERENCE TO RELATED APPLICATION

This application claims the benefit of Korean Patent Application No. 2004-13800 filed Feb. 28, 2004, in the Korean Intellectual Property Office, the entire disclosure of which is hereby incorporated by reference.

BACKGROUND OF THE INVENTION

1. Field of the Invention

The present invention relates to an electronic device. More particularly, the present invention relates to a connector opening cover unit of an electronic device, such as a digital video camera (DVC) and a digital still camera (DSC), which covers a connector unit employed for the input of initial set values of the functions, such as zoom center.

2. Description of the Related Art

An electronic device, such as a digital camcorder, converts image information captured through a photographing unit into a digital signal, and writes the digital information in a recording medium, such as a magnetic tape or a non-volatile memory. An automatic-setting function has recently been provided for the convenience of users in setting functions, such as light exposure and focusing. To achieve the automatic-setting function, it is necessary to input a variety of necessary operational data to the control part of the electronic device in the fabrication stage of the electronic device. Accordingly, a connector unit is used for the data input in the fabrication stage. However, this connector unit is not to be accessed by general users, and therefore, it is externally covered after fabrication of the electronic device to limit the access of general users.

FIG. 1 illustrates one example of fastening a connector unit cover to cover the connector unit of a digital camcorder. As shown, a digital camcorder housing 1 has a connector opening 2 that is integrally formed in the body thereof, and through which a connector unit 3 for the data input is exposed to the outside. The connector unit 3 is connected with predetermined data, and therefore received various set values of the digital camcorder.

The connector opening 2 exposing the connector unit 3 to the outside has to be covered to prevent access by general users when all the set values are transmitted to the digital camcorder. A connector opening cover 4 is provided to correspond to the connector opening 2. The connector opening cover 4 is fastened to the digital camera housing 1 by a locking projection 4' formed on a side, and a screw 5 fastened for the prevention of unintended separation.

According to the construction as described above, because the connector opening cover 4 has to be fastened to the connector opening 2 including therein the connector unit 3 by separate fastening members, such as screws 5, the volume of the product increases, and the number of parts to be fabricated also increases. Additionally, due to the requirement for the separate fastening members, such as screws 5, the price of the product also increases.

Therefore, a need exists for an electronic device having a structurally improved connector opening cover unit that does not require additional tools and fasteners to open and close the cover unit.

SUMMARY OF THE INVENTION

Accordingly, an object of the present invention is to provide a connector opening cover unit of an electronic device that is structurally improved and capable of covering a connector unit for the input of basic set values during the fabrication stage, without requiring separate fastening members.

A connector opening cover unit of an electronic device has a connector opening provided in abutment with a device accommodating opening that is selectably openable by the user. A first cover opens and closes the device accommodating opening and a second cover to open and close the connector opening. The first and the second covers are complimentarily locked with each other. The second cover utilizes the space of the device accommodating opening to slide, and is preferably slid to engagement with the first cover along a guide that is protruded from the inner boundary of the connector opening.

The above aspects and other features of the present invention may substantially be achieved by providing a connector opening cover unit that covers a connector opening of an electronic device housing to prevent externally exposing a connector unit inside the electronic device housing. The connector opening cover unit includes a device accommodating opening that may be selectably opened and closed by a user. A first cover to open and close the device accommodating opening. A connector opening formed in abutment with the device accommodating opening, and having the connector unit received therein. A second cover to open and close the connector opening. The first and the second covers are complimentarily locked with each other.

The second cover may include a connector opening cover body. A sliding protrusion is formed on both sides of the connector opening cover body to slide the second cover along the connector opening. A guide groove prevents the connector opening cover body from sinking into the connector opening. A first locking tab protrudes from an end of the connector opening cover body in the lengthwise direction. A second locking tab protrudes in opposite relation with respect to the connector opening of the connector opening cover body to restrict the sliding movement of the first cover.

The first locking tab may be seated in a first receiving groove that is formed in the inner boundary of the connector opening corresponding to the first locking tab.

The second locking tab may be seated in a second receiving groove that is formed in the electronic device housing corresponding to the second locking tab.

The connector opening cover body may be slid along a space of the device accommodating opening to cover the connector opening.

The device accommodating opening may be a secondary battery receiving opening to supply secondary power to the electronic device.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above aspects and features of the present invention will be more apparent by describing certain embodiments of the present invention with reference to the accompanying drawings, in which.

Throughout the drawings, like reference numerals will be understood to refer to like parts, components and structures.

DETAILED DESCRIPTION OF EXEMPLARY EMBODIMENTS

Certain embodiments of the present invention will be described in greater detail with reference to the accompanying drawings.

The matters defined in the description, such as a detailed construction and elements thereof, are provided to assist in a comprehensive understanding of exemplary embodiments of the invention. Thus, it is apparent that various changes and modifications may be made to the embodiments described herein without departing from the scope and spirit of the invention. Also, descriptions of well-known functions or constructions are omitted for conciseness and clarity.

Figure 1:
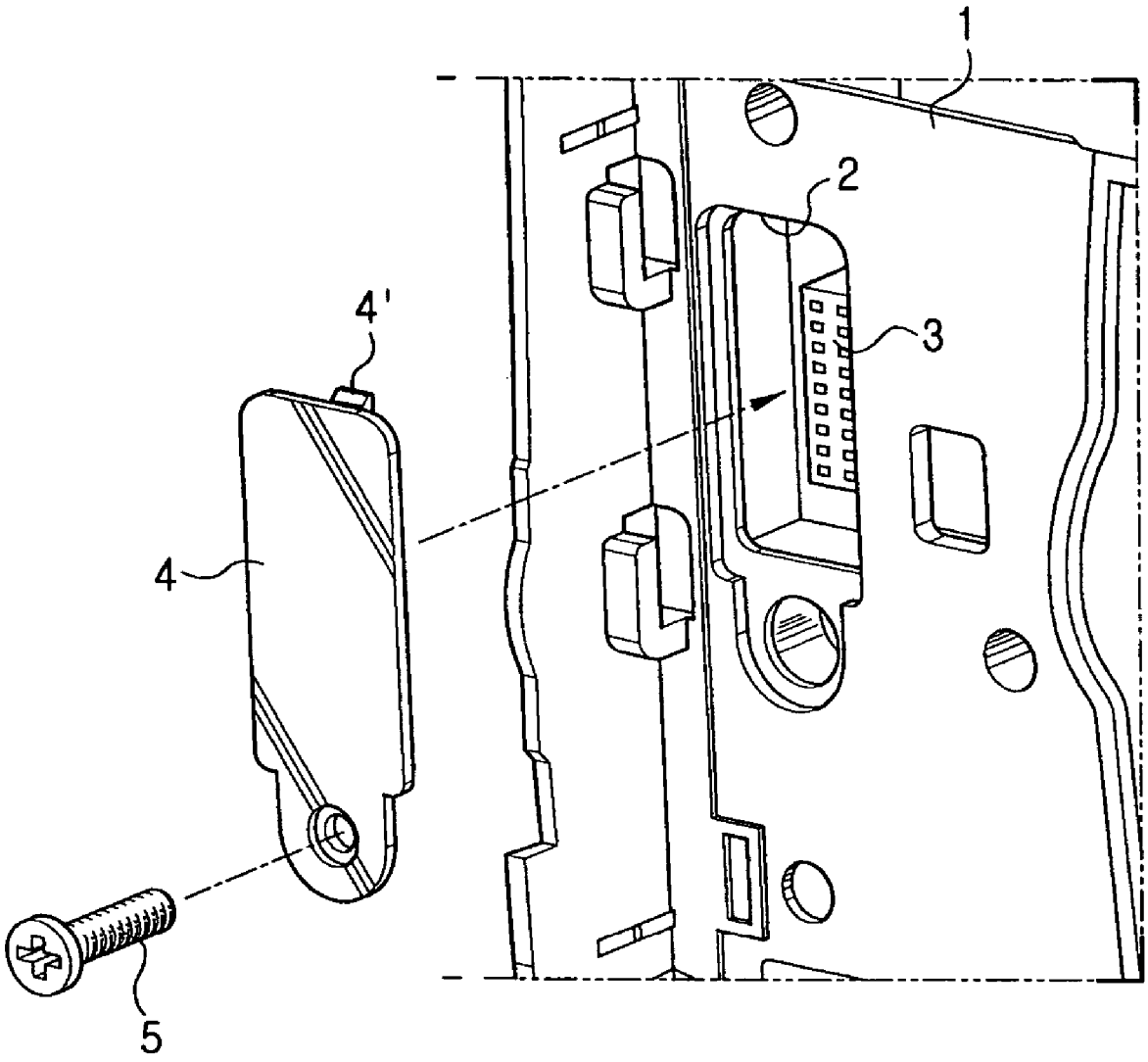
FIG. 1 (PRIOR ART)
FIG. 1 is a perspective view illustrating a conventional connector opening cover being fastened to an electronic device according to conventional art.
Figure 2:
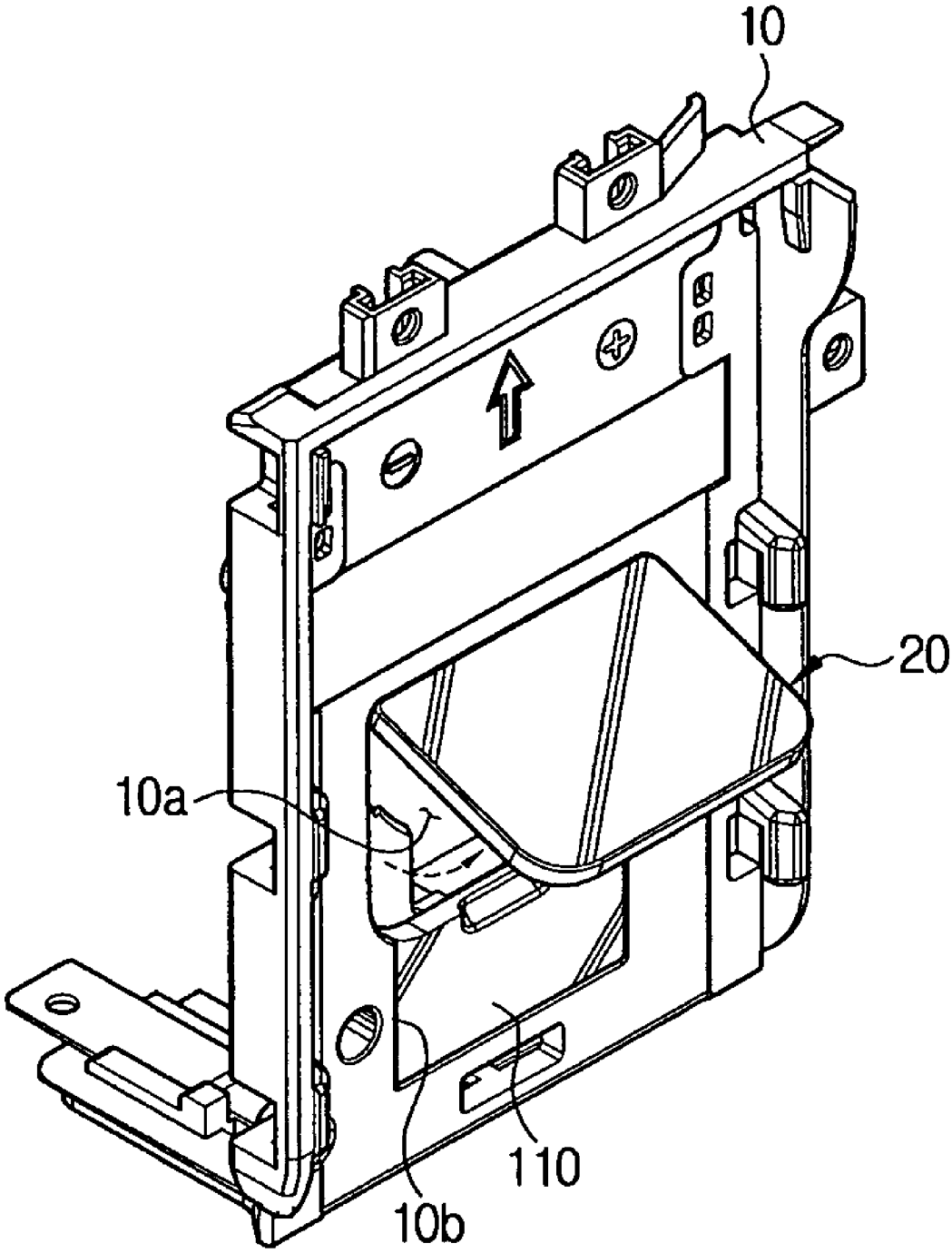
FIG. 2 is a perspective view of a connector opening cover unit having first and second covers according to an embodiment of the present invention.
Figure 3:
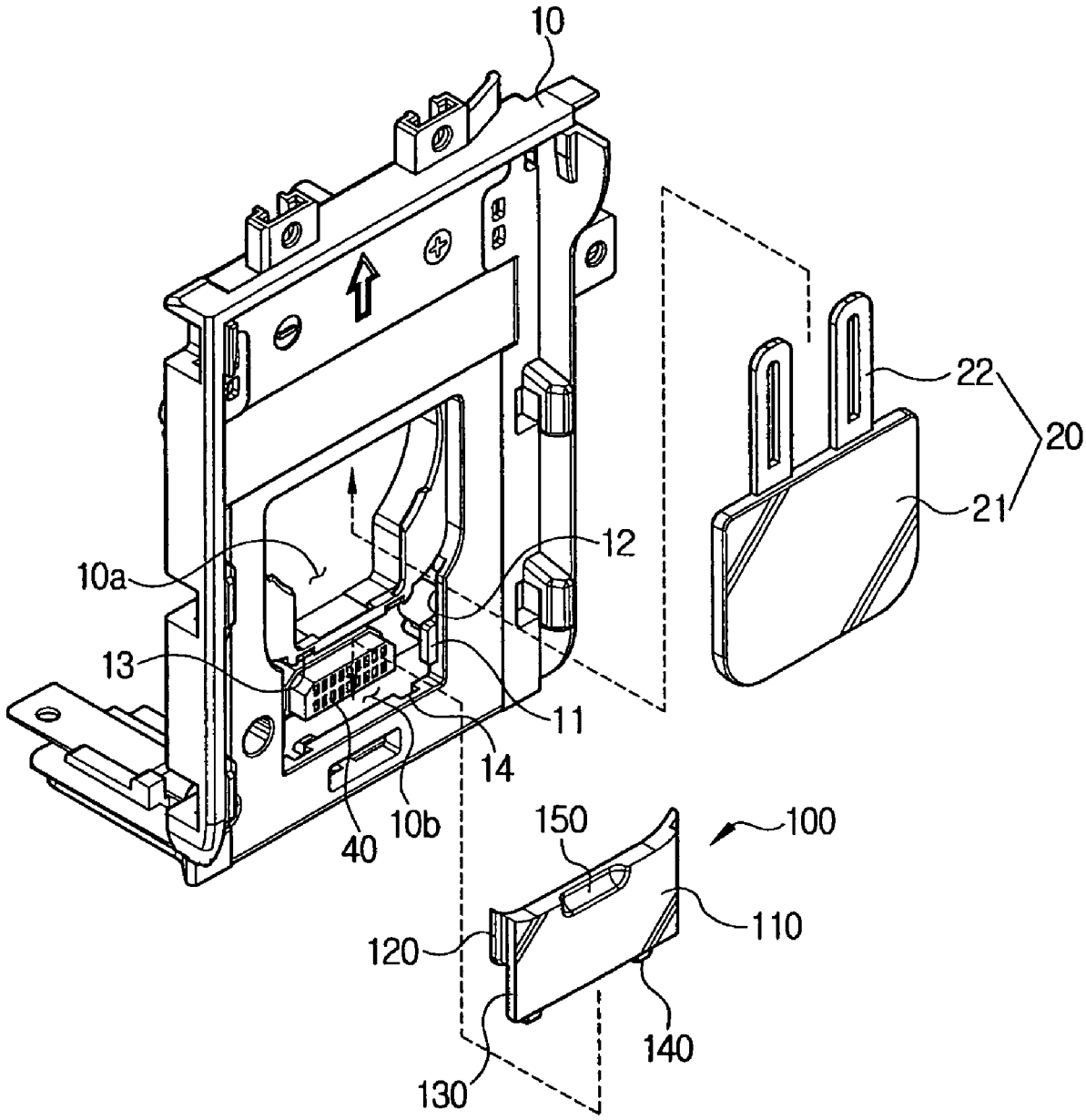
FIG. 3 is a perspective view of the first and second covers of FIG. 2 before fastening.

FIGS. 2 and 3 show a connector opening cover being assembled in accordance with an exemplary embodiment of the present invention.

More specifically, FIGS. 2 and 3 show the electronic device housing in which a rechargeable battery mounting unit 10 is provided to supply power to the electronic device, such as a camcorder. The rechargeable battery mounting unit 10 has a secondary battery receiving unit 10*a* in which a secondary battery (not shown) is mounted for the maintenance of basic information of the electronic device. The secondary battery receiving unit 10*a* may be opened and closed by a first cover 20.

The first cover 20 includes a cover body 21 aligned with the open side of the secondary battery receiving unit 10*a*, a flexible band 22, and a locking tab 23 (FIG. 6) engaged to an end of the cover body 21. The flexible band 22 firmly holds the cover body 12 to the rechargeable battery mounting unit 10, and when the cover body 21 is in open state, acts as a pivot. More specifically, because the flexible band 22 is bent by its own flexibility and acts as a pivot for the movement of the first cover 20. Thus, the freedom of opening movement of the first cover 20 is increased, and as a result, the user's convenience in opening the first cover 20 is increased. The locking tab 23 hooks the end of the second cover 100, which will be described below. The locking tab 23 may be preferably formed on a certain side of the first cover 20 that meets with the second cover 100. Additionally, an end of the locking tab 23 may preferably be rounded so that less force is required to release the first cover 20 from the second cover 100.

A connector opening 10*b* is formed in communication with the secondary battery receiving unit 10*a*, and selectively exposes the connector unit 40, which is provided for the input of basic set values of respective components of the electronic device. The connector unit 40 is provided for the transfer of basic set values to the electronic device during the fabrication process. Therefore, the connector unit 40 is covered upon completion of the fabrication to limit access by general users. As shown in FIGS. 2 through 7, the second cover 100 has a configuration corresponding to the connector opening 10*b* to fittingly cover the connector opening 10*b*.

Figure 4:
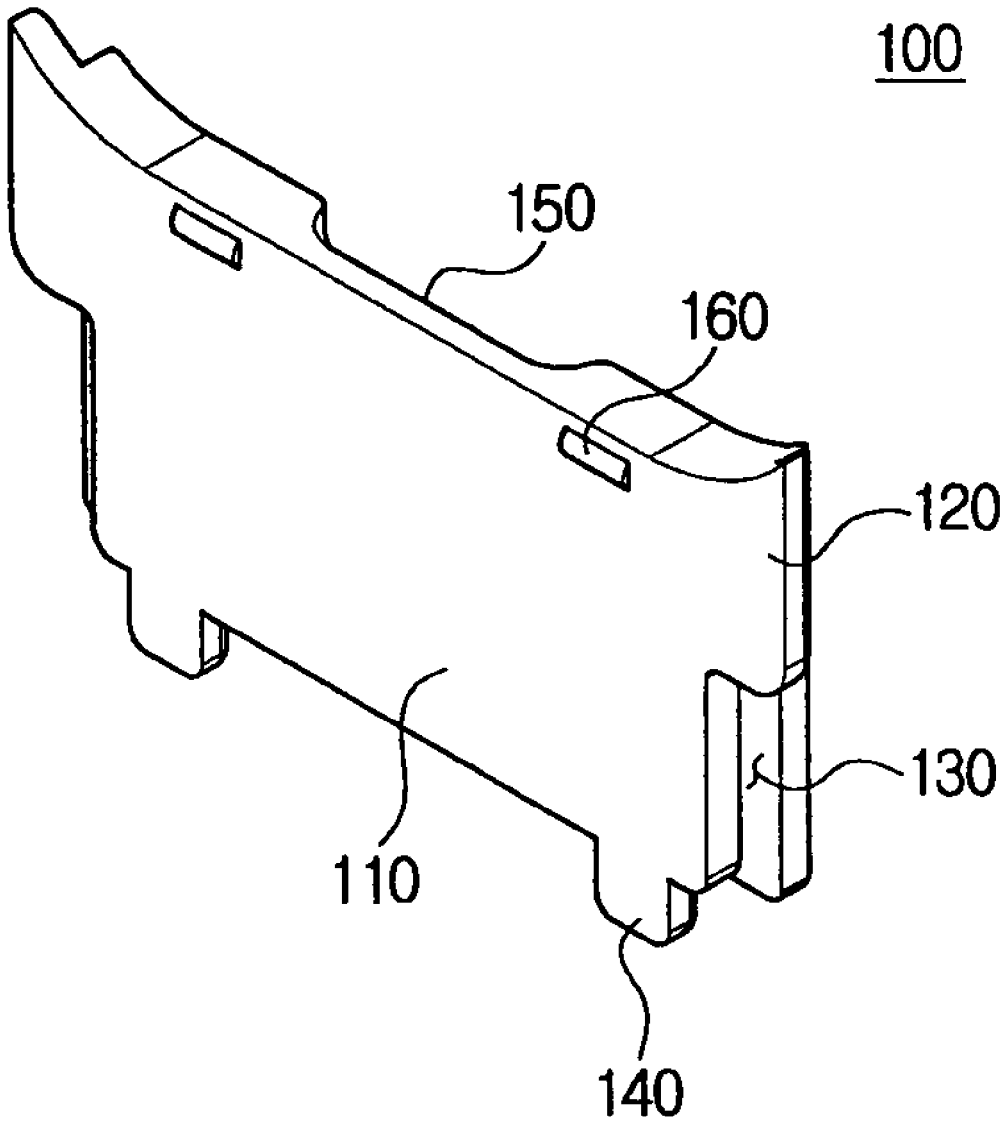
FIG. 4 is a perspective view of the second cover of FIG. 2.

Specifically referring to FIG. 4, the second cover 100 includes a connector opening cover body 110, a sliding protrusion 120, a guide groove 130, a first locking tab 140, a handgrip recess 150 and a second locking tab 160.

Figure 5:
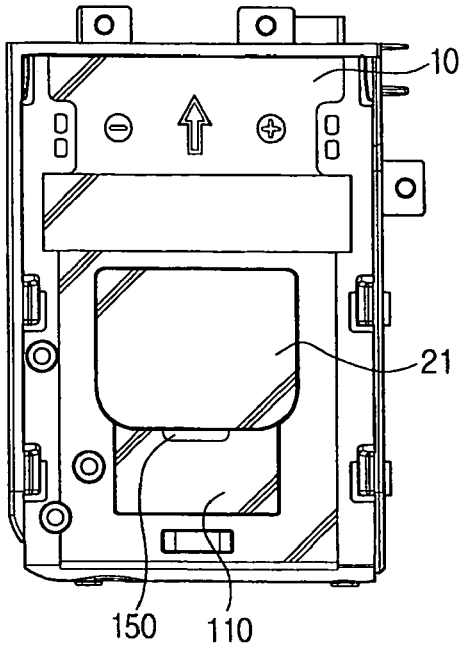
FIG. 5 is a plan view of the complementary locking of the connector opening cover of FIG. 2.

The connector opening cover body 110 has a configuration corresponding to the connector opening 10*b*, and may preferably have the thickness corresponding to that of the first cover 20. Additionally, as shown in FIG. 5, the first cover 20 and the connector opening cover body 110 are formed for complimentary fitting with each other.

The sliding protrusion 120 is supported by one end on the guiding tab 11 that protrudes from the inner boundary of the connector opening 10*b*, and slides along the sliding groove 12 that is formed along the inner boundary of the connector opening 10*b*. In one preferable example, the sliding groove 12 and the sliding protrusion 120 may be formed in respectively complimentary configurations.

The guide groove 130 is formed in a configuration complimentary with the guide 11, and while the sliding protrusion 120 is slid along the sliding groove 12, the guiding tab 11 is slid along the guide groove 130.

Accordingly, the sliding protrusion 120, the sliding groove 12, the guide groove 130 and the guiding tab 11 act as a rail that guides the sliding movement of the second cover 100, and also prevents the unintended movement of the second cover 100, such as sinking into or moving out of the housing.

first locking tab 140 prevents unintended release of the second cover 100, and more firmly maintains the locking status of the second cover. In one preferred example, as shown in FIGS. 3 and 4, a plurality of the first locking tabs 140 may be provided at the lower side of the connector opening cover body 110 facing in a downward direction. In this example, first locking tab receiving holes 14 are formed in the inner boundary of the connector opening 10*b* in locations corresponding to the first locking tabs 140 for engagement with the first locking tabs 140.

A handgrip recess 150 is provided for the user to grip on an end of the first cover 20 when releasing the locking tab 23 to open the first cover 20. The handgrip recess 150 is located at an end of the connector opening cover 110. In one preferred example, as shown in FIG. 3, the handgrip recess 150 is formed on an end of the connector opening cover body 110 that contacts the first cover 20.

The second locking tab 160 further prevents the second cover 100 from sliding. More specifically, the second locking tab 160 restricts the second cover 100 from sliding when the first cover 20 is opened such that the second cover 100 is slid only when a certain degree of force is exerted by the user. Referring to FIG. 4, the second locking tab 160 may be formed on a side opposing the handgrip recess 150. A second locking tab receiving hole 13 is formed in a corresponding location of the frame defining the rechargeable battery mounting unit 10 to receive the second locking tab 160.

Attaching and detaching the second cover 100 according to one embodiment of the present invention will be described below with reference to accompanying drawings.

Referring to FIG. 3, the rechargeable battery mounting unit 10 includes a secondary battery receiving unit 10*a* to receive a secondary battery therein and a connector opening 10*b* to externally expose the connector unit 40, which is provided for the input of basic set values of the electronic device. The secondary battery receiving unit 10*a* is adjacent the connector opening 10*b*. The secondary battery receiving unit 10*a* and the connector opening 10*b* are covered by separate cover members. In this example, the secondary battery receiving unit 10*a* is covered by the first cover 20, and the connector opening 10*b* is covered by the second cover 100.

Referring to FIG. 5, the first cover 20 completely covers the secondary battery receiving unit 10*a* formed in the rechargeable battery mounting unit 10, in complimentary engagement with the second cover 100. To open the first cover 20, the user holds the first cover 20 with a finger on the handgrip recess 150, and lifts up the first cover 20. Accordingly, the first cover 20 is opened upward as the locking tab 23 is released from the end of the second cover 100, as shown in FIG. 6.

When the first cover 20 is opened, the second cover 100, which is slidably fitted to the lower side of the first cover 20, may be slid upward and removed. More specifically, as shown in FIG. 5, the second cover 100 is restricted from moving upward by the end of the first cover 20 while the first cover 20 is in closed position, which covers the secondary battery receiving unit 10*a*. When the first cover 20 is opened, as shown in FIG. 6, the second cover 100 is released from the locked position and therefore, becomes upwardly slidable.

Figure 6:
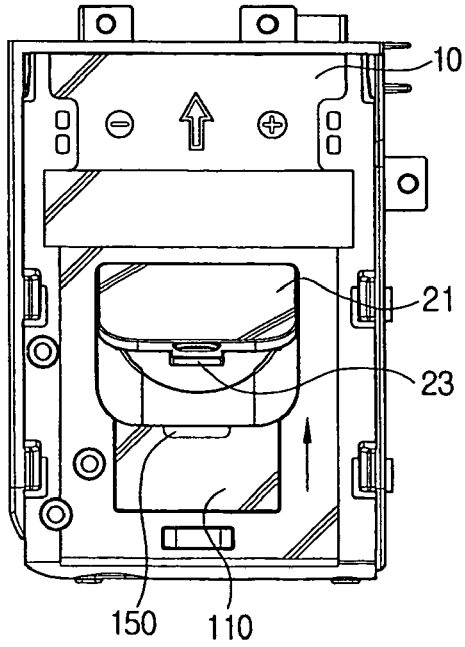
FIGS. 6 and 7 are plan views of the first cover open and the second cover sliding.
Figure 7:
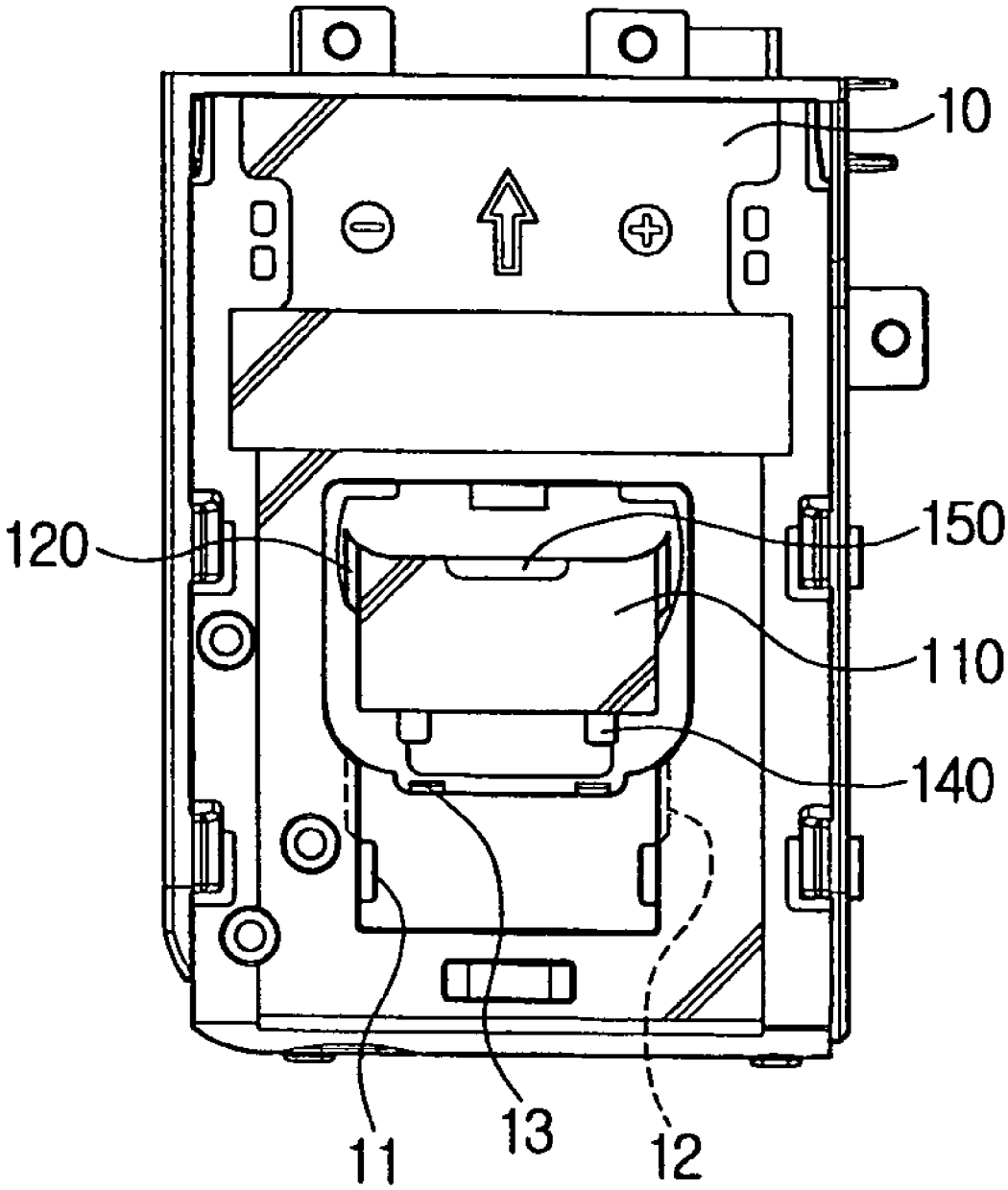

Accordingly, to remove the second cover 100 the first cover 20 is opened, and with the secondary battery receiving unit 10*a* in the opened position, the second cover 100 is slid in the direction indicated by an arrow in FIG. 6, thereby separating the second cover from the connector opening 10*b* as shown in FIG. 7.

Attaching the second cover 100 to cover the connector opening 10*b* is performed substantially reversing the above described process. That is, with the first cover 20 in the opened position, the second cover 100 is positioned toward the secondary battery receiving unit 10*a* as shown in FIG. 7. The second cover 100 is then moved toward the end of the connector opening 10*b*, that is, to the closed position so that the sliding protrusion 120 may be slid along the sliding groove 12. The second cover 100 is until the sliding protrusion 120 is proximal the upper side of the guiding tab 11 and the guiding tab 11 is seated in the guide groove 130 of the second cover 100.

When the second cover 100 is slid to the closed position of the connector opening 10*b*, the first locking tab 140 and the second locking tab 160 are respectively seated in the corresponding receiving holes 14 and 13, and as a result, the second cover 100 is fixed in the closed position.

With the connector opening cover unit as described above in a few exemplary embodiments of the present invention, the first and the second covers 20 and 100 are complimentarily locked with each other, and therefore, the inconvenience of using separate locking members or separate tools, such as a driver to fix the second cover 100, is prevented. Additionally, breakage of a locking unit due to repeatedly opening and closing the second cover 100 is prevented.

According to the present invention, a connector opening cover unit includes a first cover to open and close the secondary battery receiving unit and a second cover to open and close the connector opening, and the first and the second covers are complimentarily engaged with each other. Because separate fastening means is not required to cover the connector opening according to exemplary embodiments of the present invention, the number of fabricated parts is reduced, and the manufacturing costs are greatly reduced.

The foregoing embodiment and advantages are merely exemplary and are not to be construed as limiting the present invention. The present teaching may be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A connector opening cover unit that covers a connector opening of an electronic device housing to prevent exposing a connector unit disposed in the electronic device housing, the connector opening cover unit comprising:

a device accommodating opening selectively opened and closed by a user;

a first cover pivotably connected to the electronic device housing to open and close the device accommodating opening;

a connector opening adjacent the device accommodating opening, and having the connector unit received therein; and a second cover slidably connected to the electronic device opening to open and close the connector opening, wherein the first and second covers are adapted to complimentarily lock with each other.

2. The connector opening cover unit according to claim 1, wherein a connector opening cover body defines the second cover;

a sliding protrusion is formed on both sides of the connector opening cover body to slide along the connector opening;

a guide groove prevents the connector opening cover body from sinking into the connector opening;

a first locking tab protrudes from an end of the connector opening cover body in the lengthwise direction; and a second locking tab protrudes in an opposite relation with respect to the connector opening of the connector opening cover body to restrict the sliding movement of the first cover.

3. The connector opening cover unit according to claim 2, wherein the first locking tab is seated in a first receiving groove that is formed in the inner boundary of the connector opening corresponding to the first locking tab.

4. The connector opening cover unit according to claim 2, wherein the second locker is seated in a second receiving groove that is formed in the electronic device housing corresponding to the second locking tab.

5. The connector opening cover unit according to claim 2, wherein the connector opening cover body is slid along a space of the device accommodating hole to cover the connector opening.

6. The connector opening cover unit according to claim 1, wherein the device accommodating opening is a secondary battery receiving opening to supply secondary power to the electronic device.

7. The connector opening cover unit according to claim 1, wherein the device accommodating opening abuts the connector opening.

8. The connector opening cover unit according to claim 1, wherein the first cover has a flexible band to connect the first cover to the electronic device.

9. The connector opening cover unit according to claim 8, wherein the first cover is pivoted with respect to the electronic device about the flexible band to provide access to the device accommodating opening.

10. The connector opening cover unit according to claim 1, wherein the first cover has a third locking tab adapted to engage the second cover.

11. The connector opening cover unit according to claim 10, wherein the second cover has a recess adapted to provide access to the third locking tab of the first cover when engaged with the second cover.

12. The connector opening cover unit according to claim 8, wherein the first cover is adapted to pivot about the flexible band from a first position locked to the second cover to a second position disengaged from the second cover.

* * * * *